United States Patent [19]

Livernois et al.

[11] 4,385,456

[45] May 31, 1983

[54] PREFORMED LINING COMPONENT FOR SKATE BOOTS AND THE LIKE

[76] Inventors: Jean Livernois, 380 Victor-Hugo #2106, St-Jean sur le Richelieu, P.Q., Canada; Rolland Blais, 94 St Marguerite, St-Jean sur le Richelieu, P.Q., Canada, J3B 3Z9

[21] Appl. No.: 241,265

[22] Filed: Mar. 6, 1981

[51] Int. Cl.[3] ..... A43B 5/16; A43B 19/00

[52] U.S. Cl. ..... 36/115; 36/71; 36/89

[58] Field of Search ..... 36/71, 115, 117, 9 R, 36/10, 88, 89, 93

[56] References Cited

U.S. PATENT DOCUMENTS

| | | | |
|---|---|---|---|
| 2,433,834 | 1/1948 | Bazett et al. | 36/9 R |
| 3,407,406 | 10/1968 | Werner et al. | 36/71 X |
| 3,744,159 | 7/1973 | Nishimura | 36/71 X |
| 3,750,209 | 8/1973 | Dassler | 36/71 X |
| 3,925,916 | 12/1975 | Garbuio | 36/71 |
| 3,977,098 | 8/1976 | Chalmers | 36/71 X |

*Primary Examiner*—James Kee Chi

[57] ABSTRACT

The disclosure relates to a preformed lining component for a skate boot. The component is of laminated construction and in the specific embodiment disclosed includes a foam cushioning layer disposed between an inner layer of brushed nylon fabric and an outer vinyl layer. The component incorporates ankle pads and is manufactured on a high-frequency heat welding press which is arranged to contour the lining component for improved fit and comfort in wear.

10 Claims, 6 Drawing Figures

PREFORMED LINING COMPONENT FOR SKATE BOOTS AND THE LIKE

This invention relates generally to boots for ice skates and the like.

Ice skate boots normally comprise a boot upper, an insole, and an outsole on which the ice skate is mounted. The upper is shaped to fit around the wearer's foot and ankle and includes eyelets or other lacing arrangements, a tongue, and a toe cap which is incorporated in the front part of the upper. Traditionally, the upper has been made of leather and the boot assembled on a last, although synthetic material are often used nowadays; in some cases, the entire boot including the sole is made as a plastic moulding. Where lasting techniques are used, the upper is mounted on a last and its bottom margin is folded over and secured to an insole temporarily attached to the sole region of the last. The outsole is then secured over the insole and over the folded marginal portions of the upper. Finally, the skate is mounted on the outsole, for example, by rivets which pass through the outsole and insole. A separate lining sock is normally placed on the inner surface of the insole to cover the rivet heads.

Some type of lining will normally also be provided for the remainder of the upper; for example, relatively soft leather sections may be sewn inside the upper. While this method of boot construction has been in use for many years, it does have some drawbacks. For example, the boot tends to be rather rigid and unyielding, and as a result may not conform particularly well to the wearer's foot, which results in a poor fit and possible discomfort in wear. Also, perspiration tends to accumulate within the boot and will often soak into the lining, resulting in unpleasant odours and, in some cases, in the formation of mildew.

An object of the present invention is to provide improvements relating to linings for skate boots and the like.

According to the invention, there is provided a preformed lining component which is of laminated construction and which includes an inner layer intended for contact with a wearer's foot in use, and a cushioning layer formed by a resilient cushioning material. The two layers are co-extensive with one another and are laminated together. The inner layer comprises an air-pervious fabric which has a nap covering its exposed surface and which is capable of resisting abrasion caused by movement of a wearer's foot into and out of a boot in which the liner is fitted. The component is shaped to substantially completely surround the heel area and the sides of the ankle and foot of a wearer, and the component is adapted to be secured to the boot so as to form a permanent part thereof.

In order that the invention may be more clearly understood, reference will now be made to the accompanying drawings which illustrate a preferred embodiment of the invention by way of example, and in which.

Figure 1:
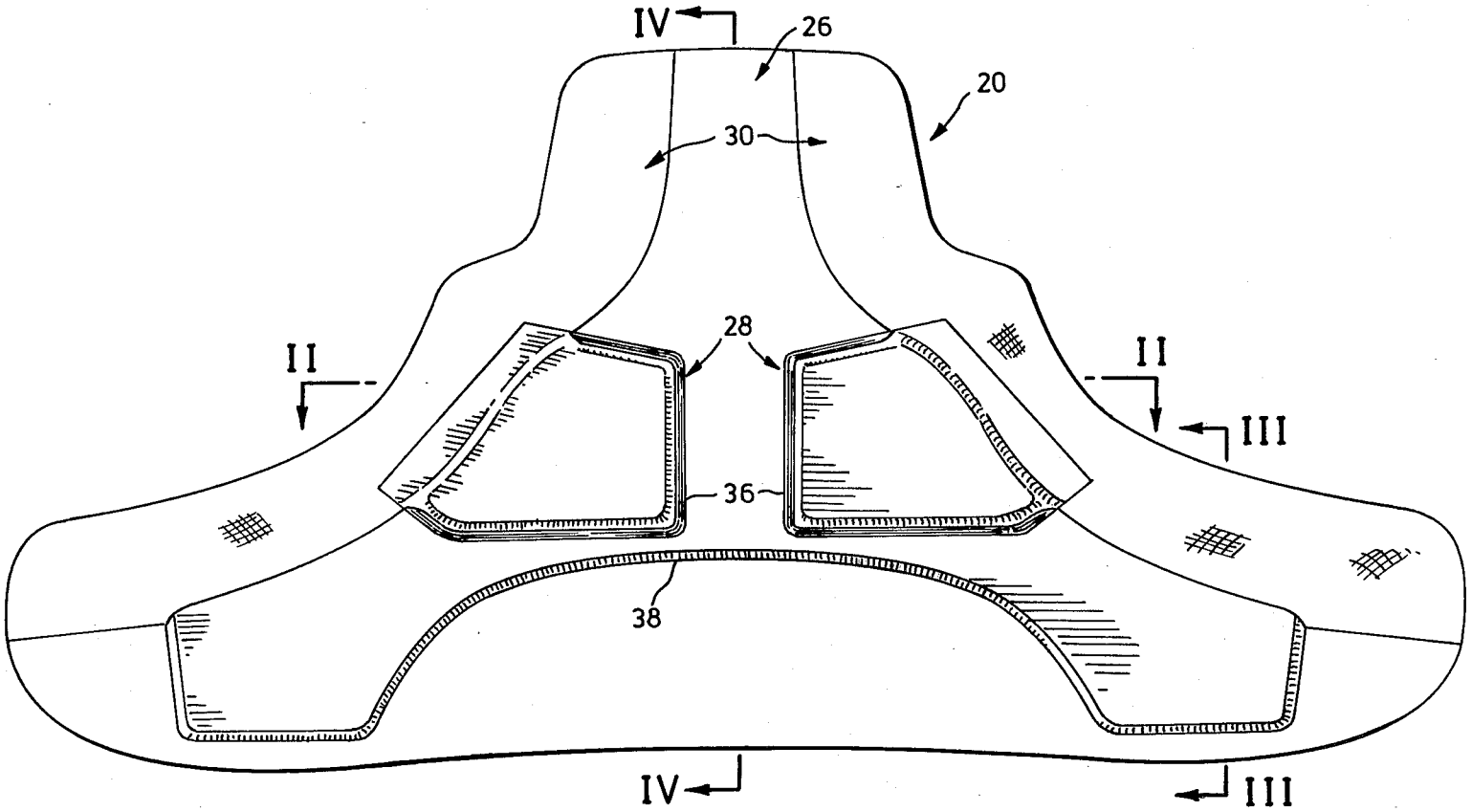
FIG. 1 is a perspective view of a preformed lining component shown in the flat as manufactured.
Figure 3:
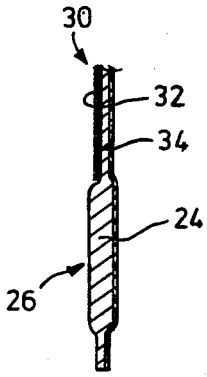
Figure 4:
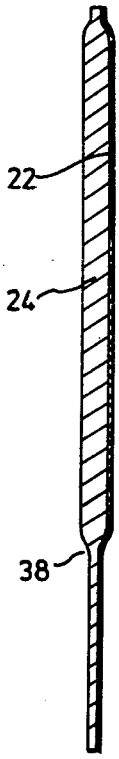
Figure 5:
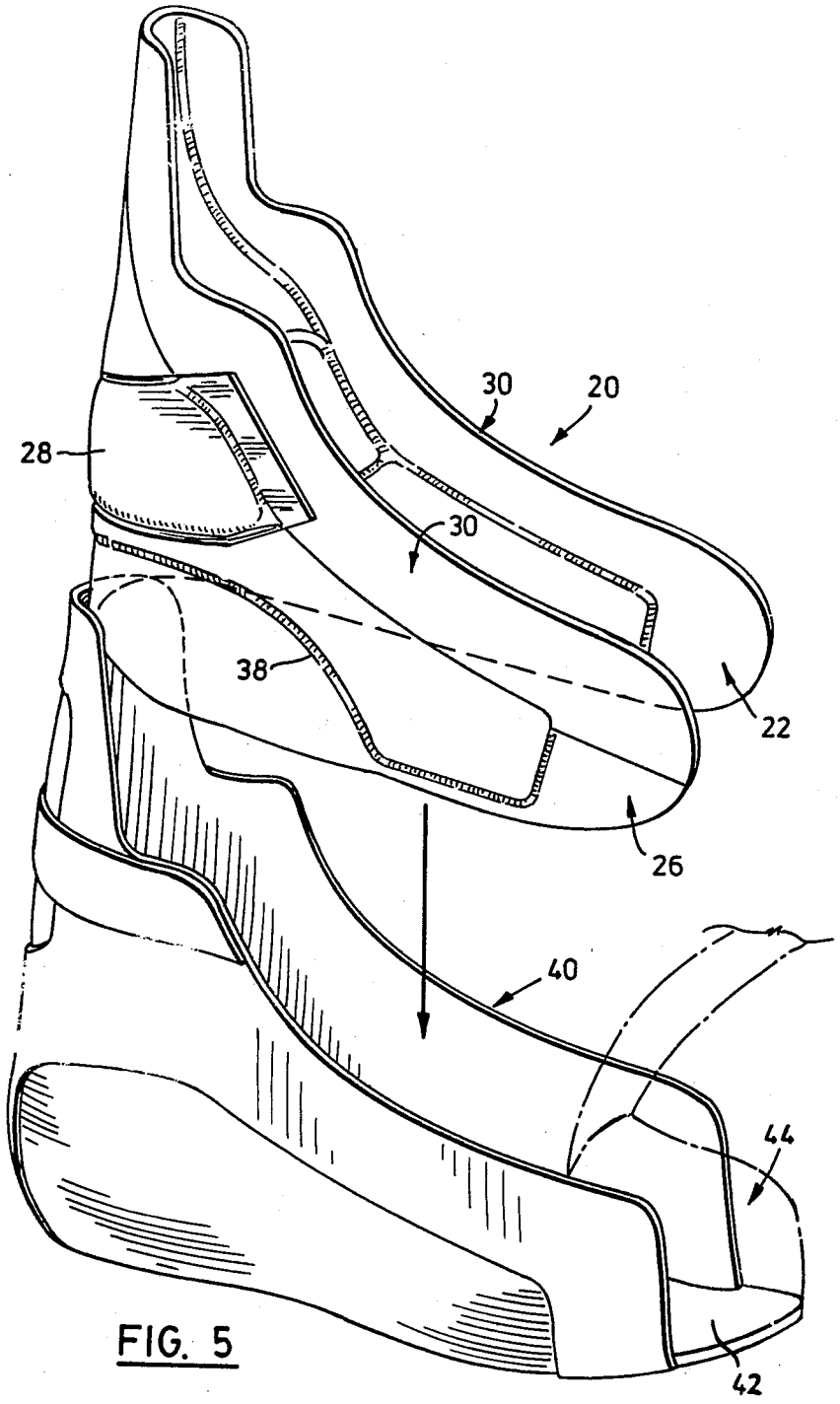
FIG. 5 is an exploded perspective view illustrating the lining component of FIGS. 1 to 4 in association with a partly finished product; and, FIG. 6 is a perspective view showing the completed boot.

Referring first to FIG. 1, a preformed lining component for a skate boot is generally denoted by reference numeral 20 and is shown in the flat form in which it is manufactured, as seen from the outer side of the component. The component is folded generally about the section line denoted IV—IV in FIG. 1 to the generally U-shaped configuration (in plan) in which it is shown in FIG. 5 for insertion into a partly finished product. The lining component is of laminated construction as will be described more particularly in connection with FIGS. 2 to 5. The component has an inner layer which is intended for contact with a wearer's foot in use and which is denoted by reference numeral 22 in FIGS. 2 to 6, but which is not visible in FIG. 1. The component also has a cushioning layer denoted by reference numeral 24 in FIGS. 2 to 4 which is formed by a resilient cushioning material and which is co-extensive with the inner layer and laminated thereto. In the particular embodiment shown in the drawings, layer 24 is in fact an intermediate layer in the structure of the component and the component also includes an outer layer denoted by reference numeral 26, (visible in FIG. 1).

Figure 6:
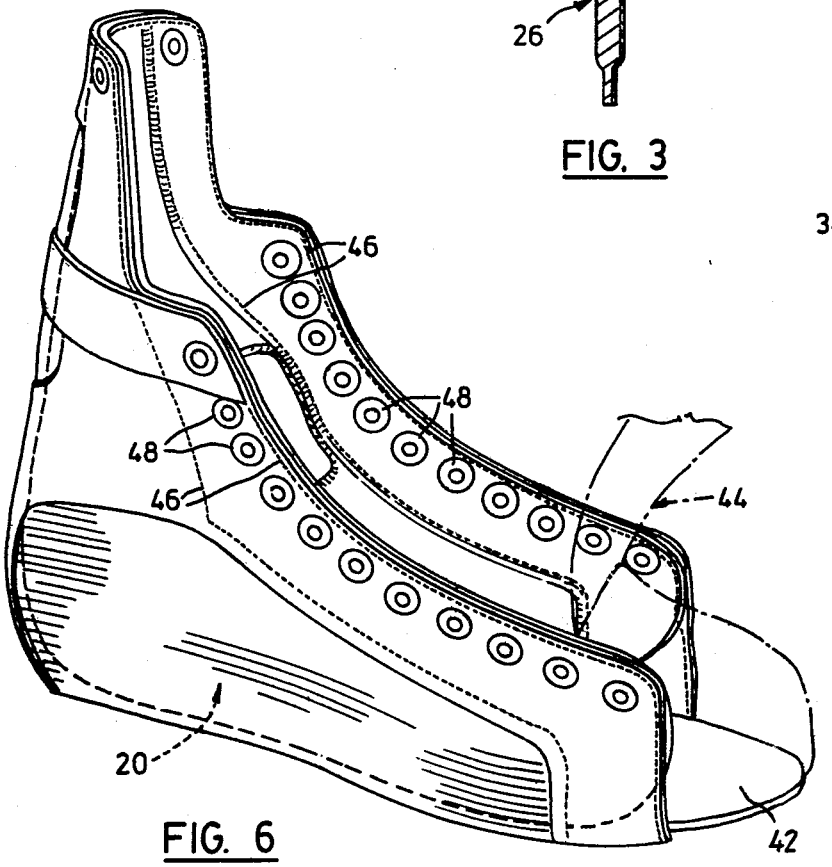

It will be appreciated from a consideration of FIG. 1 in conjunction with FIGS. 5 and 6 that the lining component is shaped to substantially completely surround the heel area and the sides of the ankle and foot of a wearer when the component is in place in a boot. The component is intended to be secured to the boot so as to form a permanent part thereof.

Figure 2:
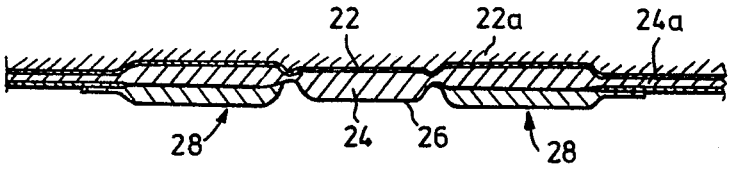
FIGS. 2, 3 and 4 are sectional views on lines II—II, III—III and IV—IV of FIG. 1 respectively.

The inner layer 22 of the component is an air-pervious fabric which has a nap covering its exposed surface and which is capable of resisting abrasion caused by movement of a wearer's foot into and out of the boot in which the lining is fitted. In this particular embodiment, the inner layer is formed by a fabric made of 100% nylon fibres. The exposed surface of the fabric has a slight nap formed by brushing the fabric. In FIG. 2, this nap is diagrammatically illustrated at 22*a* although in practice the nap would be barely visible in a section such as FIG. 2. The nap provides a soft, slightly "downy" surface on the fabric which gives the interior of the assembled boot a "warm" appearance. This particular fabric also has the advantage that it has the good abrasion resistance characteristics referred to above. The fabric is also air-pervious which allows the foot to "breathe". It is of course to be understood that while this particular fabric has been found to be eminently suitable in practice, other fabrics having equivalent characteristics could alternatively be used.

In the particular embodiment being described, the cushioning layer 24 is a resilient vinyl foam and the outer layer 26 is also made of vinyl. Again, other materials having equivalent characteristics may be used. The three layers 22, 24 and 26 are laminated togehter and are coextensive with one another. The outer vinyl layer 26 is integrally formed as a "skin" on the foam 24 while the fabric layer 22 is laminated to the other surface of the foam using a suitable adhesive. Thus, the starting material for manufacturing the lining component is a laminated 3-layer material comprising a vinyl outer layer, a foam intermediate layer and an inner brushed nylon fabric layer. The material is initially of substantially uniform thickness which may typically be of the order of a ¼". The material is die cut from stock to the outline shape shown in FIG. 1. Obviously, dies for different sizes of lining component will be provided according to the different boot sizes required but the outline will be the same in each case. It will be seen that the outline generally corresponds to the outline of the boot upper—see FIG. 5 (excluding the toe cap).

Referring now more particularly to FIG. 1, the lining component as shown in that view additionally incorporates two ankle pads denoted by reference numeral 28. The pads are shaped to cover and provide reasonable protection for the ankle bone of the wearer's foot at both sides of the ankle. Each pad is formed by a section of vinyl covered foam which is essentially the same as the vinyl-foam layer combination 26, 24 from which the body of the component is formed, except that it is of somewhat less thickness (typically ⅛"). The pads 28 are die cut from stock material and are secured to the body of the component using a high frequency heat welding press (see later).

The lining component as seen in FIG. 1 also incorporates two reinforced areas through which lacing eyelets are inserted in the finished boot—see FIG. 6. In these areas, the three layer "base" material of the component is reinforced by two reinforcing sections 30 which are die cut from laminated nylon with duck reinforcing (a commercially available material) and heat welded to the "base" material. Thin laminated nylon material essentially comprises an outer woven canvas layer (which would be visible at the outer surface of the component as seen in FIG. 1), backed by a vinyl foam incorporating woven nylon fibres as reinforcement. Since this is a commercially available material it has not been shown in detail in the drawings; however, in FIG. 3, part of one of the sections 30 is visible and its outer canvas layer is indicated at 32 and the nylon reinforced backing at 34.

In manufacturing the component, the die cut ankle pad sections 28 and eyelet reinforcing sections 30 are placed on a pre-cut section of the base material in a high frequency heat welding press as discussed above which is operated to fuse the ankle pad sections and the eyelet reinforcing sections 30 to the base material. Heated surfaces of the press form the heat seals indicated at 36 in FIG. 1 around three sides of each ankle pad. The fourth side of each pad overlies the appropriate one of the eyelet reinforcing sections 30 and is heat welded to that section. The remainder of each pad is unaffected by the press and retains its natural resiliency due to its foam structure. Other heated areas of the press are applied over the entire area of each eyelet reinforcing section 30 so that those sections are fused to the outer vinyl layer 26 of the main part of the component. The press is designed so these heated areas cause the intermediate foam layer 24 to be permanently compressed below each section 30 as indicated at 24*a* in FIG. 2. This has the effect of "contouring" the components so that it is somewhat thinner in the eyelet reinforcing areas, where resiliency is not a requirement.

The heated surfaces of the press are also designed to "contour" the remainder of the component along a line generally indicated at 38 is FIG. 1 so that the areas of the component below that line and outwardly of that line adjacent the eyelet reinforcing sections 30 are also of somewhat reduced thickness and hence less resilient that the remainder of the component (see FIG. 4). The effect of this "contouring" is to reduce the thickness of or "relieve" the component in the region of the bottom of the heel and around the sides of the heel of the wearer. It has been found in practice that this avoids undue pressure in these areas, which makes for increased comfort, while providing for greater padding and protection in other areas (e.g. in the region of the Achilles' tendon) where greater protection is required. In other words, the component is "contoured" for maximum comfort and protection of the wearer. This "contouring" is effected by compressing the foam layer within the component under the effect of the heated press surfaces so that the foam structure is permanently deformed and adopts a reduced thickness.

FIG. 5 shows the completed lining component arranged in the configuration it will adopt in use. A boot upper into which the component is to be fitted is generally denoted 40 and has been secured to an insole 42 in known manner. A toe cap component and associated tongue which will be added to complete the boot are indicated at 44 in ghost outline. It will of course be appreciated that the lining component can be fitted to the upper at any convenient stage during manufacture of the boot. The component does not extend down into the toe cap area of the boot and can therefore even be installed after the toe cap has been fitted. Alternatively, the lining component and upper could be secured together in the flat before the upper and insole are secured together.

FIG. 6 shows the completed boot, again with the toe cap and tongue indicated in ghost outline only. The lining component 20 is secured in place using adhesive (not shown) in the quarter regions of the boot and by lines of stitching indicated at 46. For convenience of illustration, other lines of stitching used in constructing the upper have not been shown. FIG. 6 also shows a conventional arrangement of eyelets, denoted 48, which have been inserted through both the upper and the lining component (in the areas of the reinforcing sections 30).

The finished boot will have an external appearance which is essentially the same as a conventional boot. The boot interior will have a "warm" appearance due to the nap on the inner surface of the lining component. In wear, the lining component will fit snugly around the foot of the wearer and will provide cushioned padding in the heel area and around the sides of the foot, with additional padding in the area of the ankle bone, provided by the ankle pads 28. It is anticipated that the wearer wil find the boot to be exceptionally comfortable compared with conventional boots. At the same time, perspiration which accumulates in the boot in wear cannot penetrate through the lining due to the presence of the impervious outer layer 26. The component will be unaffected by moisture since it is constructed entirely of synthetic materials.

It is also believed that, by using a preformed lining component, manufacturing will be simplified and less costly.

It should finally be noted that the preceding description relates to a particular embodiment of the invention and that many modifications are possible. For example, there is no limitation to the particular materials described. Also, it should be understood that the lining component provided by the invention may be used in boots other than those of the type shown in the drawings. It would even be possible to use the lining component in a moulded plastic boot, in which the component would probably be secured inside the boot using adhesive only.

Constructional details of the lining component itself may also vary. For example, in some cases, the outer layer 26 may be omitted. Also, the ankle pads 28 and the contouring described above are not essential within the broad scope of the invention.

The preceding description has been restricted to use of the lining component in boots for ice skates. It should be noted that there is no limitation in this regard and that the expression "boots for ice skates and the like" is intended to include boots used in other sporting activities, for example, for roller skating boots and possibly even ski boots.

I claim:

1. A skate boot and the like comprising an upper defining a space for receiving a wearer's foot, and a preformed lining component disposed in said space and permanently secured to said upper so as to form an integral part of the boot, the component comprising a unitary structure of three imperforate layers laminated together in continuous surface-to-surface contact, said layers comprising: an inner layer which is intended for contact with a wearer's foot in use and which is formed by an air-pervious fabric having a nap covering its exposed surface and capable of resisting abrasion caused by movement of a wearer's foot into and out of the boot; an intermediate cushioning layer which is formed by a resilient cushioning material; and an outer layer which is co-extensive with said inner layer and cushioning layer and which is made of a water impervious material, said air-pervious fabric and said resilient cushioning material being synthetic materials unaffected by moisture.

2. A preformed lining component for a skate boot and the like as claimed in claim 1, said component comprising a unitary structure of three imperforate layers laminated together in continuous surface-to-surface contact and shaped to substantially surround the heel area and the sides of the ankle and foot of a wearer of said boot and the like, said layers comprising an inner layer which is intended for contact with a wearer's foot in use and which is formed by an air-pervious fabric having a nap covering its exposed surface and capable of resisting abrasion caused by movement of a wearer's foot into and out of the boot; an intermediate cushioning layer which is formed by a resilient cushioning material; and an outer layer which is co-extensive with said inner layer and cushioning layer and which is made of a water impervious material, said air-pervious fabric and said resilient cushioning material being synthetic materials unaffected by moisture.

3. The invention of claim 1 comprising respective ankle pads secured to said outer surface of the lining component and shaped to cover areas of said component disposed in the region of the ankle bone of a wearer at both sides of the ankle, each said pad including a foam material for protectively cushioning the ankle areas of the wearer.

4. The invention of claim 1 said cushioning layer is contoured to provide relieved areas which are of reduced thickness compared with the remainder of said component in the area of the rear and sides of the lower heel of a wearer.

5. The invention of claim 1, wherein said upper includes areas provided with lacing eyelets, and wherein the component includes sections of reinforcing material inwardly of said areas, through which said eyelets extend.

6. The invention of claim 5, wherein said reinforcing material is a canvas backed with nylon-reinforced foam.

7. The invention of claim 1 said air-pervious fabric is a 100% nylon fabric.

8. The invention of claim 1 said resilient cushioning material is vinyl foam.

9. The invention of claim 1 said cushioning material is a vinyl foam, and wherein said outer layer comprises an integral vinyl layer on said foam.

10. A skate boot and the like comprising an upper defining a space for receiving a wearer's foot, and a preformed lining component disposed in said space and secured to said upper so as to form a permanent part of the boot, the component being of laminated construction and comprising an inner layer which is intended for contact with a wearer's foot in use, and a cushioning layer which is formed by a resilient cushioning material and which is co-extensive with the inner layer and laminated thereto, the inner layer comprising an air-pervious fabric which has a nap covering its exposed surface and which is capable of resisting abrasion caused by movement of a wearer's foot into and out of the boot, the component being shaped to substantially completely surround the heel area and the sides of the ankle and foot of a wearer.

* * * * *